US007600967B2

(12) United States Patent
Pezzetti, Jr. et al.

(10) Patent No.: US 7,600,967 B2
(45) Date of Patent: Oct. 13, 2009

(54) STATOR ASSEMBLY, MODULE AND METHOD FOR FORMING A ROTARY MACHINE

(75) Inventors: Michael C. Pezzetti, Jr., Vernon, CT (US); Peter A. Faucher, Brooklyn, CT (US); Daniel E. Kane, Tolland, CT (US); Randall R. Good, Simpsonville, SC (US)

(73) Assignee: United Technologies Corporation, Hartford, CT (US)

( * ) Notice: Subject to any disclaimer, the term of this patent is extended or adjusted under 35 U.S.C. 154(b) by 749 days.

(21) Appl. No.: 11/193,863

(22) Filed: Jul. 30, 2005

(65) Prior Publication Data

US 2007/0025837 A1 Feb. 1, 2007

(51) Int. Cl.
*F04D 29/08* (2006.01)
*F04D 29/12* (2006.01)

(52) U.S. Cl. ..... 415/173.1; 415/173.3; 415/115

(58) Field of Classification Search ..... 415/1, 415/11, 13, 173.1, 173.3, 115, 116, 135, 415/136, 138, 139; 29/28, 450, 451, 464, 29/468, 469; 277/644, 647, 641
See application file for complete search history.

(56) References Cited

U.S. PATENT DOCUMENTS

| | | | | | |
|---|---|---|---|---|---|
| 3,966,356 | A * | 6/1976 | Irwin | ..... | 415/173.3 |
| 5,145,316 | A * | 9/1992 | Birch | ..... | 415/173.1 |
| 5,188,506 | A * | 2/1993 | Creevy et al. | ..... | 415/115 |
| 5,423,659 | A * | 6/1995 | Thompson | ..... | 415/173.1 |
| 5,971,703 | A * | 10/1999 | Bouchard | ..... | 415/135 |
| 5,993,150 | A * | 11/1999 | Liotta et al. | ..... | 415/115 |
| 6,435,820 | B1 * | 8/2002 | Overberg | ..... | 415/138 |

* cited by examiner

*Primary Examiner*—Edward Look
*Assistant Examiner*—Dwayne J White
(74) *Attorney, Agent, or Firm*—Gene D. Fleischhauer

(57) ABSTRACT

A stator assembly for a rotary machine having an array of wall segments for bounding a working medium flow path is disclosed. Various construction details which provide a sealing structure for the segments are developed. In one detailed embodiment, a removable seal retainer for a seal chamber bounded by wall segments traps a resilient seal member in the seal chamber. In one particular embodiment, a modular subassembly for the engine is an outer air assembly disposed in a fixture as the subassembly is assembled.

11 Claims, 4 Drawing Sheets

172
38
44a
36
74
182
178
176
174
175
186
184
Af,As
96
64
42
44a
168rr
162
166
164
168a
P
G
62
74
38c
168fr
152r
154r
158r
156a
152
154
156
158a
152a
154a
156r
158

STATOR ASSEMBLY, MODULE AND METHOD FOR FORMING A ROTARY MACHINE

TECHNICAL FIELD

This invention relates to axial flow rotary machines of the type having a flowpath for working medium gases and a stator structure extending circumferentially with respect to the working medium flow path. More particularly, this invention relates to a stator assembly having an array of wall segments that extend circumferentially for bounding the working medium flow path, such as an outer air seal or the platforms of an array of stator vanes. While this invention was conceived during work in the field of axial flow gas turbine engines, this invention has application to other fields which employ rotary machines.

BACKGROUND OF THE INVENTION

An axial flow, gas turbine engine typically has a compression section, a combustion section and a turbine section. An annular flowpath for working medium gases extends axially through the sections of the engine. A stator assembly extends inwardly and outwardly of and about the annular flowpath for confining the working medium gases to the flowpath and for directing the working medium gases along the flowpath.

As the gases are passed along the flowpath, the gases are pressurized in the compression section and burned with fuel in the combustion section to add energy to the gases. The hot, pressurized gases are expanded in the turbine section to produce useful work. A major portion of this work is used as output power, such as for driving a free turbine or developing thrust for aircraft.

A remaining portion of the work generated by the turbine section is not used for output power. Instead, this portion of the work is used in the compression section of the engine to pressurize the working medium gases for the combustion section and for providing cooling air to selected locations in the engine. A rotor assembly extends through the engine for transferring this work from the turbine section to the compression section. The rotor assembly has arrays of rotor blades in the compression section for doing work on the working medium gases and arrays of rotor blades in the turbine section for receiving work from the working medium gases. The rotor blades in the turbine section have airfoils that extend outwardly across the working medium flowpath. The turbine airfoils are angled to the approaching flow to receive the work from the gases and to drive the rotor assembly about the axis of rotation.

The stator assembly in both sections has an inner case and an outer case for bounding the working medium flowpath. Arrays of stator vanes extend across the working medium flowpath between the cases. The arrays of stator vanes are disposed in interdigitated fashion with the arrays of rotor blades. Each stator vane includes an outer wall segment or platform which bound the flow path, forming an array of outer wall segments. Each stator vane has one or more airfoils that extend inwardly from the outer platform. The airfoils direct the approaching flow to the adjacent row of rotor blades at the desired angle.

The stator assembly further includes a second array of wall segments which are disposed between the arrays of stator vanes and outwardly of the rotor blades. The second array of wall segments, commonly referred to as an outer air seal, are supported from the outer case and extend circumferentially about the working medium flowpath. The segments are circumferentially spaced leaving a clearance gap therebetween. The clearance gap is provided to accommodate changes in diameter of the array of wall segments in response to operative conditions of the engine as the outer case is heated and expands or is cooled and contracts.

The stator assembly includes a support structure, such as upstream support and a downstream support, for supporting the seal segments of the outer air seal from the outer case. The seal segments are adapted by flanges to engage the supports. These flanges are typically called "hooks." The outer case and the support structure position the seal segments in close proximity to the blades and provide a seal surface which radially faces the working medium gases. The seal surface blocks the leakage of working medium gases past the tips of the rotor blades.

The inwardly facing surfaces of the seal segments are commonly formed with abradable material to enable the seal segments to accept rubbing contact with the tips of the rotor blades under operative conditions. As a result, the rotor blades exert a circumferential force and moment on the seal segments urging the seal segments in the circumferential direction about the axis of the engine. The forces and the moment are resisted by the support structure.

The outer air seal assembly typically includes pins that extend between one of the supports and the outer air seal segment to restrain the segments against the circumferentially directed forces. An example of such pins is shown in U.S. Pat. 4,247,248 issued to Chaplin, DeTolla and Griffin entitled "Outer Air Seal Support Structure For Gas Turbine Engine." In addition to resisting the forces and moments arising from rubbing contact between the rotor blades and the surface of the outer air seal segment, these pins locate the outer air seal segments. These pins require the machining of appropriate openings to receive the pins, require installation in a location that is difficult to reach and to inspect, and, require the manufacture and maintenance of additional parts for the engine.

As a result of being disposed adjacent to the flowpath, the surfaces of the segments and the segments themselves are in intimate contact with the hot working medium gases. The segments receive heat from the gases and the segments are cooled to keep the temperature of the segments within acceptable limits. Pressurized cooling air is flowed from supply chambers on the interior of the outer air seal assembly through cooling air holes to the exterior surface of the segments. The cooling air provides transpiration cooling as the air passes through walls of the seal segments and, after the air is discharged from the segments, provides film cooling with a film of air on the exterior of the segments. The film of cooling air provides a barrier between the segments and the hot, working medium gases.

Leak paths exist from the supply chambers of cooling air to the working medium flowpath because of the segmented nature of the outer air seal segments and the supports. These leak paths divert cooling air away from locations where the cooling air provides helpful cooling. These leak paths decrease the aerodynamic efficiency of the engine because the engine expended work to compress the cooling air. Any reduction in cooling air consumption reduces the performance penalty caused by the work of pressurization. As a result, seal chambers are provided to intercept the leak paths at critical locations in the engine to decrease the loss of cooling air.

One example of such a seal chamber in another part of the turbine section is shown in U.S. Pat. No. 4,336,943 issued to Chaplin entitled "Wedge-Shaped Seal for Flanged Joints." In Chaplin, the seal chamber is provided with a seal member or ring. The ring has arms which open toward a region of higher pressure. The arms are each urged against a surface bounding the seal chamber to block the loss of cooling air from the engine.

This type of seal member is also employed adjacent to outer air seal assemblies in conjunction with the support for the adjacent array of stator vanes. The vane support and the outer air seal assembly form the seal chamber for the seal member to locate, position, and retain the seal member. Inspection of the disposition of the seal member after installation requires disassembly of the adjacent vane support.

The above art notwithstanding, scientists and engineers working under the direction of Applicants' Assignee have sought to develop structure for blocking a leak path through a seal chamber that uses a resilient seal member disposed between two circumferentially extending structures bounding the flow path and which facilitates assembly, disassembly and inspection of the disposition of the resilient seal member and locating and retaining the resilient seal member under non-operative and operative conditions of the engine.

SUMMARY OF INVENTION

According to the present invention, a stator assembly has two circumferentially extending structures that are spaced apart leaving an annular seal chamber therebetween for intercepting a leak path for cooling air, the stator assembly including a resilient seal member that extends across the space between the structures to divide the seal chamber into a high pressure region and a low pressure region and that has arms opening toward the high pressure region to engage the structures and further including a retainer member extending across the space in the low pressure region that is removably attached to a portion of the stator assembly for locating and retaining the resilient seal member and for providing access to the chamber during assembly and disassembly of the resilient seal member.

In accordance with the present invention, a stator assembly for a rotary machine having a resilient seal member which extends circumferentially in an annular seal chamber and axially between a first structure and a second structure further includes a retainer member that is removably attached to one of the structures and that extends axially and faces radially to bound the seal chamber, the resilient seal member being urged radially against the retainer member and urged axially against the first structure and the second structure by pressurized cooling air of the leak path to block the flow of cooling air through the seal chamber, the retainer member providing access to the seal chamber for installing, locating and enclosing the seal member under non-operative conditions of the engine and for retaining the seal member radially against cooling air pressure under operative conditions.

In accordance with one embodiment of the present invention, the rotary machine has a flow path for working medium gases, the second structure is an array of circumferentially extending wall segments each having a surface that bounds the flow path for working medium gases and the first structure extends circumferentially about and outwardly of the wall segments to provide a support for both the retainer member and the stator members.

This invention in one embodiment is in part predicated on the recognition that the seal chamber may be formed for use with a coolable outer air seal assembly which includes an outer air seal support for the outer air seal and that the retainer member may provide access to the chamber for disposing a resilient seal member in the chamber and, in a detailed embodiment, retain the outer air seal against circumferential movement.

In accordance with one particular embodiment, the wall segments of the second structure are an array of outer air seal segments that slidably engage the circumferentially extending support and the seal chamber is bounded axially on one side by the support and bounded axially on the other side by a seal wall extending from the hooks of at least two outer air seal segments. The seal wall extends about the support and is spaced axially from the support.

In accordance with one embodiment of the present invention, the retainer member is formed of an array of retainer segments which are engaged by the array of outer air seal segments, with at least one segment of one of the arrays having a radially extending anti-rotation projection which extends into an associated opening in a segment of the other array of segments such that the retainer member both prevents circumferential movement of the array of outer air seal segments and fixes the location of the resilient seal member.

In accordance with one embodiment of the present attention, the retainer member is a cast member formed with the opening and the outer air seal is a cast member formed with the projection.

In accordance with one detailed embodiment, the retainer member has a first wall or support arm which extends axially and circumferentially to bound the seal chamber and a second wall which extends circumferentially and radially from the first wall to form a corner with the first wall, the second wall extending radially inwardly into close proximity with the portion of the outer air seal member axially bounding the seal chamber leaving a radial gap R therebetween which is spaced from the top and bottom of the seal chamber, the second wall extending radially adjacent to the opening in the retainer member to reduce bearing stresses resulting from engagement between retainer member and the anti-rotation projection on the outer air seal by increasing the area of engagement with the second wall of the retainer member and reducing the turning moment on the retainer member by having the anti rotation projection on the outer air seal member extend outwardly to engage the first wall of the retainer member at a diameter which is greater than the diameter of the remainder of the outer air seal segment.

In accordance with another detailed embodiment, the axial thickness of the radial wall on the retainer member is less than the axial thickness of the inwardly extending wall of the outer air seal member to promote engagement between the base of the resilient seal member and the wall of the outer air seal segment.

In accordance with one embodiment, the axial gap between the support and the support arm of the retainer member is smaller than the axial gap between the wall of the resilient seal member at the tip or outer diameter of the resilient seal member.

In one detailed embodiment, the axial length of the resilient seal member in the uninstalled condition is greater than the axial length of the seal chamber such that the resilient seal member in the uninstalled condition has an axial length which is greater in the uninstalled condition and than in the installed condition.

In accordance with one detailed embodiment, the resilient seal member is an accordion shaped resilient seal member having an uninstalled axial length between the sealing surfaces of the seal member that is greater than the installed axial length between the sealing surfaces.

In accordance with one detailed embodiment, the orientation of the accordion seal member under operative conditions causes the pressure of the cooling air from the outer air seal to urge the sealing surfaces of the accordion seal member against the outer air seal member and the support.

According to the present invention, a method of forming the outer air seal assembly includes forming a cartridge-like module of an outer air seal assembly which includes an outer air seal support, a plurality of outer air seal segments and a retainer member with a radially extending seal member extending between the structures and trapped with the retainer member. The method includes forming a module by disposing the outer air seal assembly in a first fixture having grooves for receiving the rearward side of the outer air seal assembly, the fixture extending outwardly of the outer diameter of the outer air seal assembly; forming a second module by disposing the outer air seal assembly in a second fixture having a diameter that is smaller than the outer diameter of the outer air seal assembly; inserting the second module in the rotary machine; securing the outer air seal assembly to the rotary machine and removing second fixture from the engine.

A primary feature of the present invention is a first structure and a second structure which form a seal chamber for a seal member. Another primary feature is a retainer member for the seal member which is disposed in the seal chamber. In one particular embodiment, the retainer member extends between the structures and is supported by being attached to one of the structures that form the seal chamber. In one embodiment, a feature is the modular nature of a subassembly formed by a fixture and an outer air seal assembly. In one detailed embodiment, the modular outer air seal assembly includes an outer air seal support, a plurality of outer air seal segments and the retainer member with a radially extending seal member extending between the structures and trapped with the retainer member. In one detailed embodiment, a feature is an anti rotation projection extending radially between an outer air seal segment and the retainer member that is attached to one member and extends into a slot in the other. In one detailed embodiment, a feature is a hook on an outer air seal segment having a seal wall extending radially from the outer air seal segment to bound the seal chamber and a lug extending radially from the wall to form the radially extending anti-rotation projection.

A principal advantage of the present invention is the engine efficiency which results from blocking the loss of cooling air from a coolable stator assembly of a rotary machine which results from forming a seal chamber and disposing a resilient seal member in the chamber. In one embodiment another advantage is the life-cycle cost of an assembly having a seal chamber and a resilient seal member associated with the ease of manufacture, repair and inspection of the assembly that results from use of a modular type subassembly containing the seal member. In particular, ease of manufacture is promoted by supporting the second structure from the first structure, disposing the seal member in the seal chamber and attaching the retainer member from the first structure to form the modular subassembly. In one detailed embodiment, an advantage is the durability of the seal retainer associated with the level of force it uses to resist the anti-rotation moment acting on the seal segment during a rub of a rotor blade. The force is lower with the anti-rotation projection or lug extending outwardly from the hook of the outer air seal segment to a larger diameter as compared to the moment arm that results from having the lug extend inwardly from the seal retainer to engage the outer air seal segment at a smaller diameter.

The resilient seal member is disposed in the seal chamber and urged axially by cooling air pressure against the support and the outer air seal members under operative conditions, the outer air seal assembly further including a circumferentially extending retainer member which is removably attached to the support for providing access to the seal chamber and which extends axially to bound the seal chamber for enclosing the seal member in the seal chamber, for locating the seal member under non-operative conditions, and for retaining the seal member radially against cooling air pressure under operative conditions.

The foregoing features and advantages of the present invention will become more apparent in light of the following detailed description of the invention and the accompanying drawings.

DETAILED DESCRIPTION OF THE INVENTION

Figure 1:
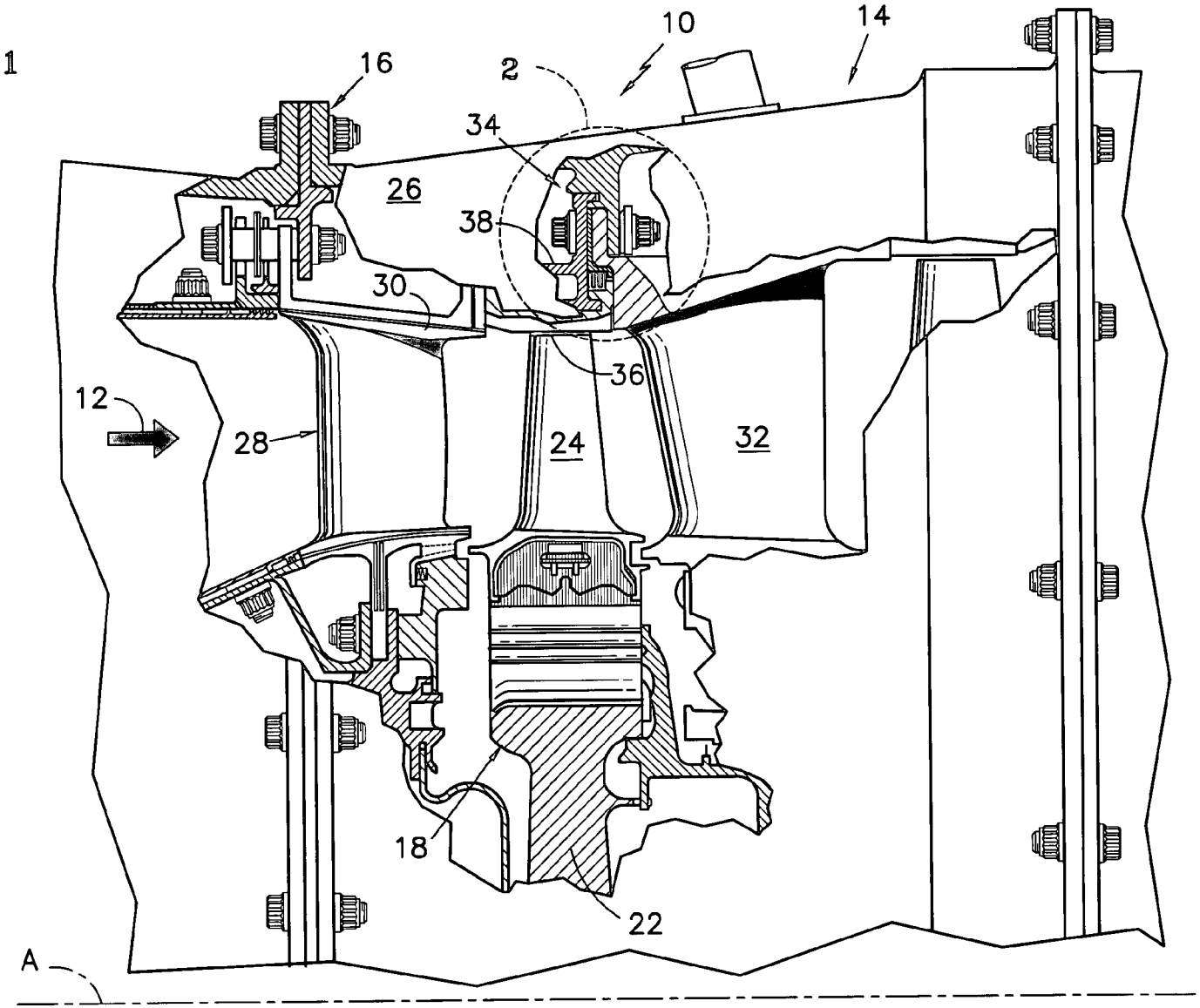
FIG. 1 is a side elevation view of the turbine section of a rotary machine which is partially broken away to show a cross-sectional view of a portion of the interior of the turbine section.

FIG. 1 is a side elevation view of a rotary machine, such as a gas turbine engine 10, having an axis of symmetry A. The engine 10 is partially broken away to show a cross-sectional view of the interior. The engine 10 has an annular flowpath 12 for working medium gases. The annular flowpath is disposed about the axis A and extends axially through the engine 10. The engine 10 includes a turbine section 14 having a stator assembly 16 and a rotor assembly 18 which each extend circumferentially with respect to the flowpath 12. The rotor assembly includes a rotor disk 22 and an array of rotor blades, as represented by the rotor blade 24. The rotor blades extend outwardly across the working medium flowpath into close proximity with the stator assembly.

The stator assembly 16 includes an outer case 26 and arrays of stator vanes 28, 32. The first array of stator vanes 28 extends inwardly from the outer case across the working medium flowpath 12. The first array of stator vanes are upstream of the array of rotor blades 24. The second array of stator vanes 32 is similarly disposed downstream of the array of rotor blades. An outer air seal assembly 34 having an outer air seal 36 is disposed between the first and second arrays of stator vanes. The outer air seal assembly has a first structure, as represented by an outer air seal support 38, which extends inwardly from the outer case to support and position the outer air seal. The outer air seal is coolable and forms a second structure of the outer air seal assembly.

Figure 2:
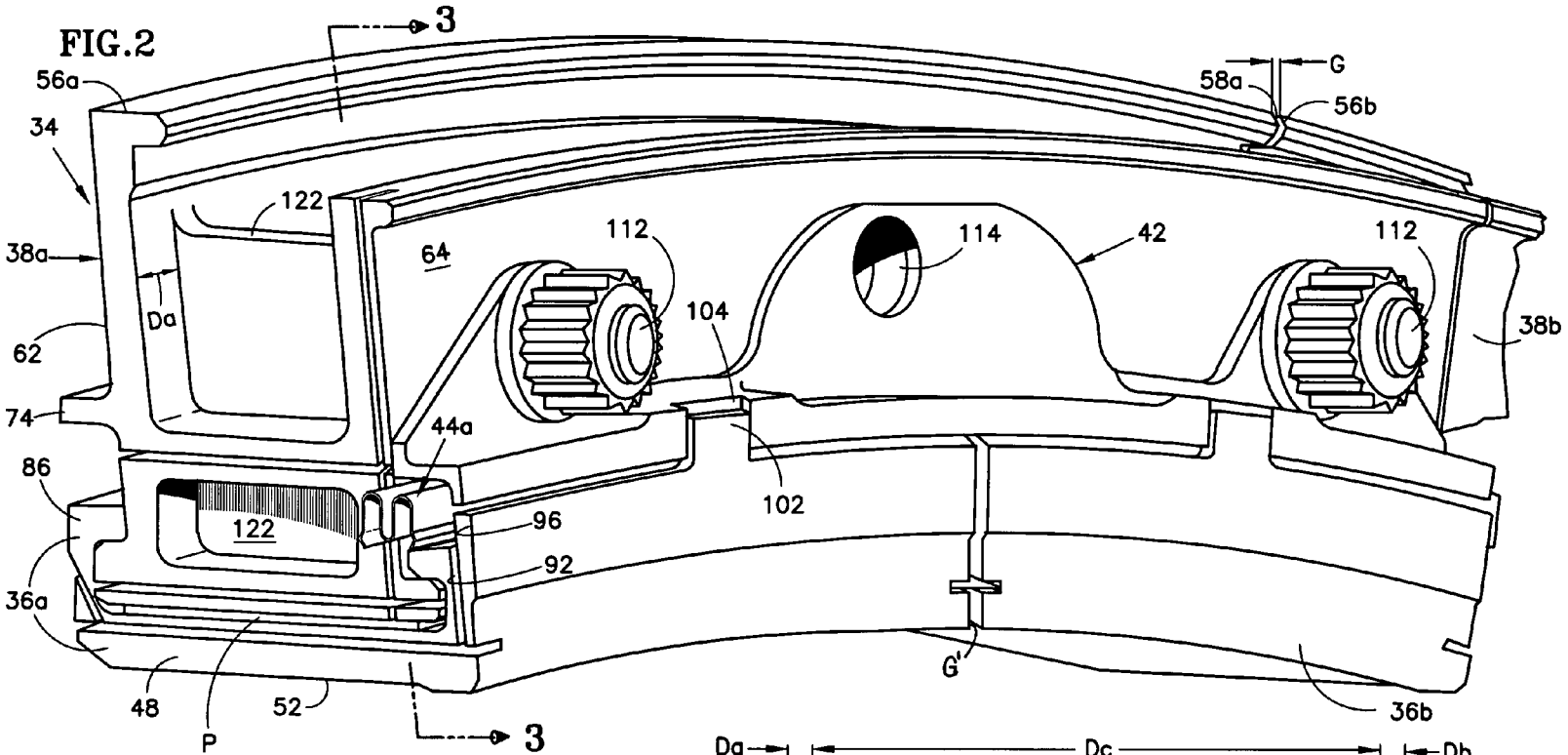
FIG. 2 is a perspective view from the rear of part of the structure shown in FIG. 1 showing a portion of an outer air seal assembly formed by an outer air seal support, a plurality of outer air seal segments and a retainer member with a radially extending seal member extending between the structures and trapped with the retainer member.

FIG. 2 is a perspective view from the rear of part of the structure shown in FIG. 1 showing a portion of the outer air seal assembly 34 in more detail. As noted above, the outer air seal assembly is formed in part by the outer air seal support 38 and the outer air seal 36. The outer air seal assembly further includes a retainer member 42 and an axially extending seal member 44 extending between the structures, as represented by the seal member embodiment 44*a*. The seal member is resiliently formed of a thin metal structure. The seal member is trapped radially between the structures 36,38 with the retainer member 42.

The outer air seal 36 is formed of a plurality of outer air seal segments, as represented by the wall segments 36*a*, 36*b*. The outer air seal has a seal section 48 having a seal surface 52, as represented by this seal surfaces 52*a*, 52*b*. The seal surface 52 extends circumferentially about the axis A and axially outwardly of the array the rotor blades 24 shown in FIG. 1 to bound the working medium flowpath 12. The seal surface of the outer air seal blocks the leakage of hot working medium gases past the tips of the rotor blades.

The outer air seal support 38 extends circumferentially about and outwardly of the outer air seal 36 to support the segments 36*a*, 36*b* of the outer air seal. In this particular embodiment, the outer air seal support is formed of a plurality of segments, as represented by the segments 38*a*, 38*b*. Each support segment engages two associated outer air seal segments 36*a*, 36*b*. Each support segment has a first side 56, as represented by the sides 56*a*, 56*b*, which face circumferentially. A second side 58, as represented by the side 58*a*, faces circumferentially and is spaced circumferentially from the first side of the adjacent segment by a circumferential gap G.

Figure 3:
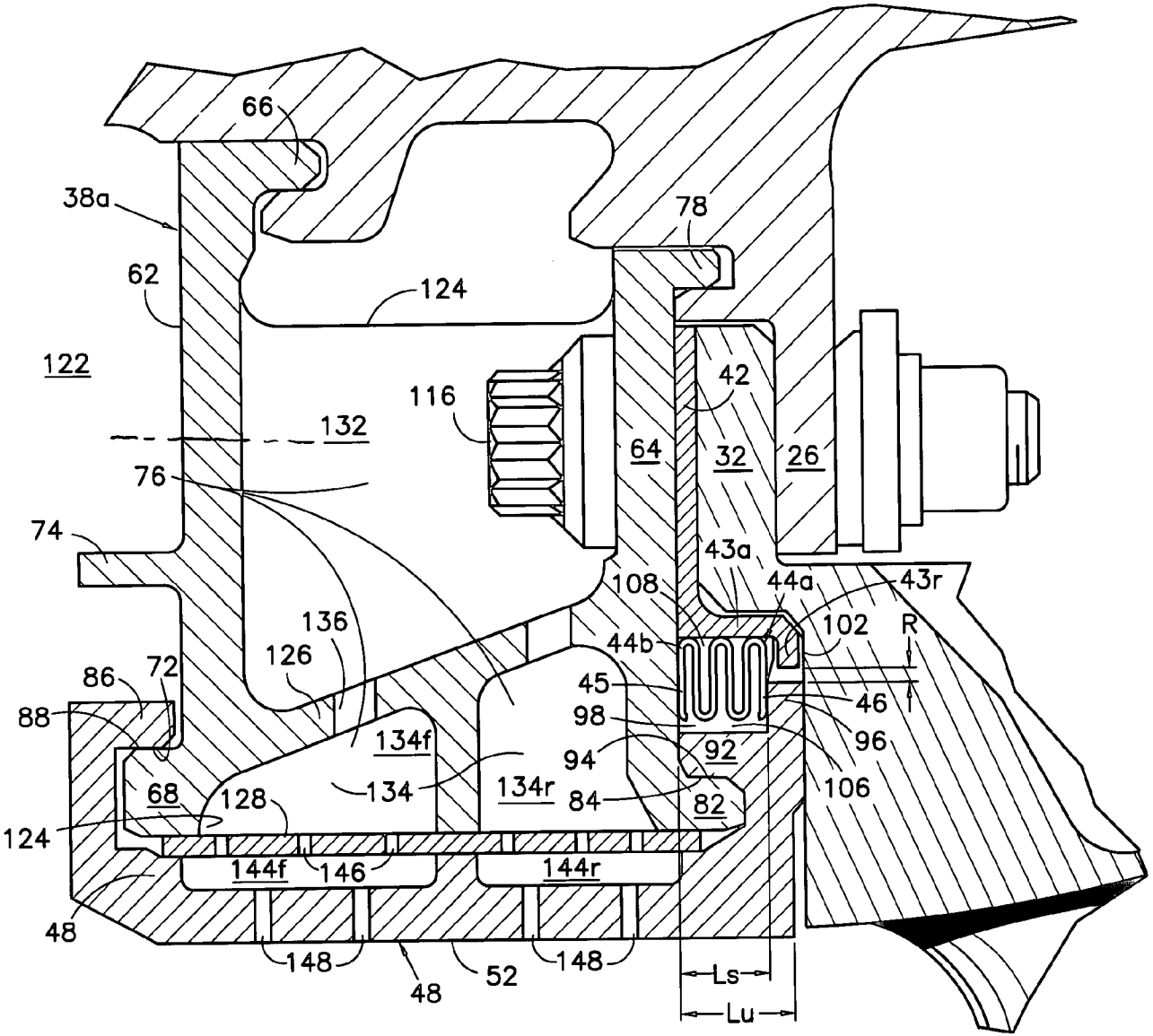
FIG. 3 is an enlarged view of a portion of FIG. 1 showing a resilient seal member and the adjacent structure which traps the seal member.

FIG. 3 is a cross-sectional view taken along the lines 3-3 of the structure shown in FIG. 2. FIG. 3 shows an alternate embodiment 44*b* of the resilient seal member 44*a* shown in FIG. 2. The resilient seal member 44*b* is also disposed between the adjacent structures 36, 38 which trap the seal member. As shown in FIG. 2 and FIG. 3, the support segment 38*a* has a forward wall 62 and a rearward wall 64. The walls adapt the segment to engage the outer case 26. In particular, the forward wall has a forward outer rail 66 which engages the outer case. A forward inner rail 68 is spaced radially from the forward outer rail. The forward inner rail extends axially in the forward direction and has an outwardly facing surface 72 which extends circumferentially about the axis As. A circumferentially extending projection 74 extends axially from the forward wall.

The rearward wall 64 is spaced axially from the forward wall 62 leaving a portion of a supply region 76 for cooling air therebetween. The rearward wall has a rearward outer rail 78 which engages the outer case. A rearward inner 82 rail is spaced radially from the rearward outer rail. The rearward inner rail 82 extends axially in the rearward direction. The rearward inner rail 82 has an outwardly facing surface which extends circumferentially about an axis As which is coincident with the axis A in the installed condition.

As shown in FIG. 2 and FIG. 3, the inner rails of each of the outer air seal support segments, as represented by the inner rails 68, 82 of support segment 38*a*, engages a pair of outer air seal segments 36*a*, 36*b*. Each outer air seal segment has a forward hook 86. The forward hook extends axially forward from the seal section 48 over the inner rail 68 of the forward wall 62 of the support segment. The forward hook has an inwardly facing surface 88 which slidably engages the outwardly facing surface 72 of the forward rail 68 of the associated support segment 38*a* of the outer air seal support.

Each outer air seal segment 36*a* also has a rearward hook 92 which extends axially rearward from the seal section 48. The rear ward hook extends over the rearward inner rail 82 of the support segment 38*a*, which is the first structure of the outer air seal assembly. The rearward hook has an inwardly facing surface 94 which slidably engages the outwardly facing surface 84 of the rearward rail 82 of the associated segment of the outer air seal support.

A radially extending seal wall 96 extends inwardly from the rearward hook 92. The seal wall extends circumferentially and is spaced from the rearward wall 64 of the outer air seal support segment 38*a* leaving the annular seal chamber 98 therebetween. An anti-rotation projection 102 extends radially from the seal wall. The anti-rotation projection 102 is adapted to extend into an associated opening of the stator assembly, such as the opening 104 in the retainer member 42. As mentioned above, the retainer member is attached to the first structure, that is, the outer air seal support segment 38*a*.

The resilient seal member 44*b* extends across the axial length Ls of the seal chamber 98 between the rearward wall 64 of the first structure and the seal wall 96 of a the second structure (outer air seal segment 38). The resilient seal member divides the seal chamber into a high pressure region 106 and a low pressure region 108.

The retainer member 42 is disposed in the low pressure region 108. The retainer member faces radially and extends axially across the axial length Ls of the seal chamber 98 to bound the seal chamber. The retainer member is removably attached to the outer air seal support 38 (that is, the first structure of the stator assembly) by a pair of circumferentially spaced bolts 112.

A third bolt hole 114 is provided for receiving an attachment bolt 116. The attachment bolt is provided for attaching the outer air seal assembly 34 to the outer case 26. As shown in FIG. 1 and FIG. 3, the third bolt and its hole extend through the rearward wall 64 of the outer air seal support 38, the retainer member 42, a portion of the stator vane 32, and the outer case 26. An opening 118 (shown by the centerline) in the forward wall 62 of the outer air seal support 38 provides access to the interior of the support for installing the third bolt and for use with the fixtures shown in FIG. 5 and FIG. 5A. The opening also places the supply region 76 for cooling air in flow communication with a source of cooling air 122.

The retainer member 42 has the radially extending opening 104 for receiving the anti-rotation projection 102. Accordingly, the retainer member both: locates and retains the resilient seal member 44*b* against the pressure forces of the high and low pressure regions 106,108; and, locates and retains the outer air seal segment 36*a* against circumferential displacement. The retainer member 42 also provides access to the seal chamber 98 during assembly and disassembly of the resilient seal member, As shown in FIG. 2, the supply region 76 for cooling air is disposed outwardly of the outer air seal 36 for supplying cooling air to the outer air seal. The outer air seal support 38 bounds the supply region for cooling air. The bounding structure of each segment of the outer air seal support includes the forward wall 62 which extends circumferentially and the rearward wall 64 which is spaced axially from the forward wall. The rearward wall extends circumferentially leaving the supply region therebetween. These walls axially bound the supply region.

Figure 2A:
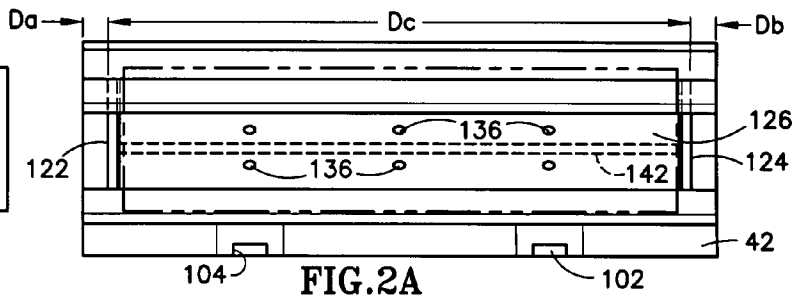
FIG. 2A is a top view of an inner partition which is attached to the outer air seal support at a location on the interior of the outer air seal assembly shown in FIG. 2, the inner partition being displaced circumferentially in the installed position from the location P shown in FIG. 2.

FIG. 2A is a top view of a portion of the outer air seal assembly 34 shown in FIG. 2. FIG. 2, FIG. 2A and FIG. 3 show elements of the outer air seal support 38, such as a first radially extending bulkhead 122, a second radially extending bulkhead 124, and a first or outer partition 126. The cooling air supply region 76 is circumferentially bounded by the first radially extending bulkhead and the second radially extending bulkhead. The first radially extending bulkhead is spaced by a distance Da from the first side. The second bulkhead is spaced by a distance Db from the second side and by a distance Dc from the first bulkhead. The distance Dc is greater than the distance Db.

Figure 2B:
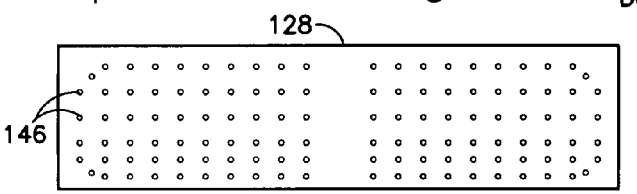
FIG. 2B is a top view of the portion of the outer air seal assembly shown in FIG. 2 showing a first radially extending bulkhead, a second radially extending bulkhead, and an outer partition for the outer air seal support.

FIG. 2B is a top view of a second or inner partition 128. As shown in FIG. 3, the inner partition is attached to the outer air seal support by any suitable means, such as by tack welding the partition to the support. As shown in FIG. 2A, the inner partition extends circumferentially so that it overlaps the bulkheads 122, 124. As shown in FIG. 2 and FIG. 2A, the inner partition in the installed condition is radially aligned with the location P but is displaced circumferentially from the location P.

As shown in FIG. 3, the first or outer partition 126 of the support segment 38*a*, extends circumferentially and extends from the forward wall 62 to the rearward wall 64. The first partition divides the supply region 76 into an outer cooling air chamber 132 and an inner cooling air chamber 134. The first partition has a plurality of cooling air holes 136 which place the inner chamber in flow communication with the outer chamber.

As shown in FIG. 3, the second partition 128 is inwardly of the first partition and is attached to the forward and rearward walls 62, 64. The second partition extends circumferentially and extends from the forward wall 62 to the rearward wall. The second partition is spaced radially outwardly from the first partition to bound the inner cooling air chamber 134. The first bulkhead 122 circumferentially bounds the inner cooling air chamber 134 and circumferentially bounds a portion of the outer cooling air chamber 132. The second bulkhead also extends radially to circumferentially bound the inner cooling air chamber and circumferentially bounds a portion of the outer cooling air chamber. As shown in FIG. 2A and FIG. 3, the outer air seal support segment 38*a* has a third bulkhead 142 which extends circumferentially to divide the inner chamber 134 into a forward compartment 134*f* and a rearward compartment 134*r*.

As shown in FIG. 3, the second partition 128 is spaced radially outwardly from the seal section 48 of the outer air seal 36. This spacing leaves a cooling air chamber 144 for the outer air seal therebetween. The second partition has a plurality of cooling air holes 146 that place the inner cooling air chamber 134 in flow communication with the exterior of the outer air seal support structure and the cooling air chamber 144 for the outer air seal, as represented by the compartments 144*f*, 144*r*. A plurality of cooling air holes 148 extend through the seal section of the outer air seal to place the outer cooling air chamber in flow communication with the exterior of the outer air seal.

Figures 4, 5, 5A:
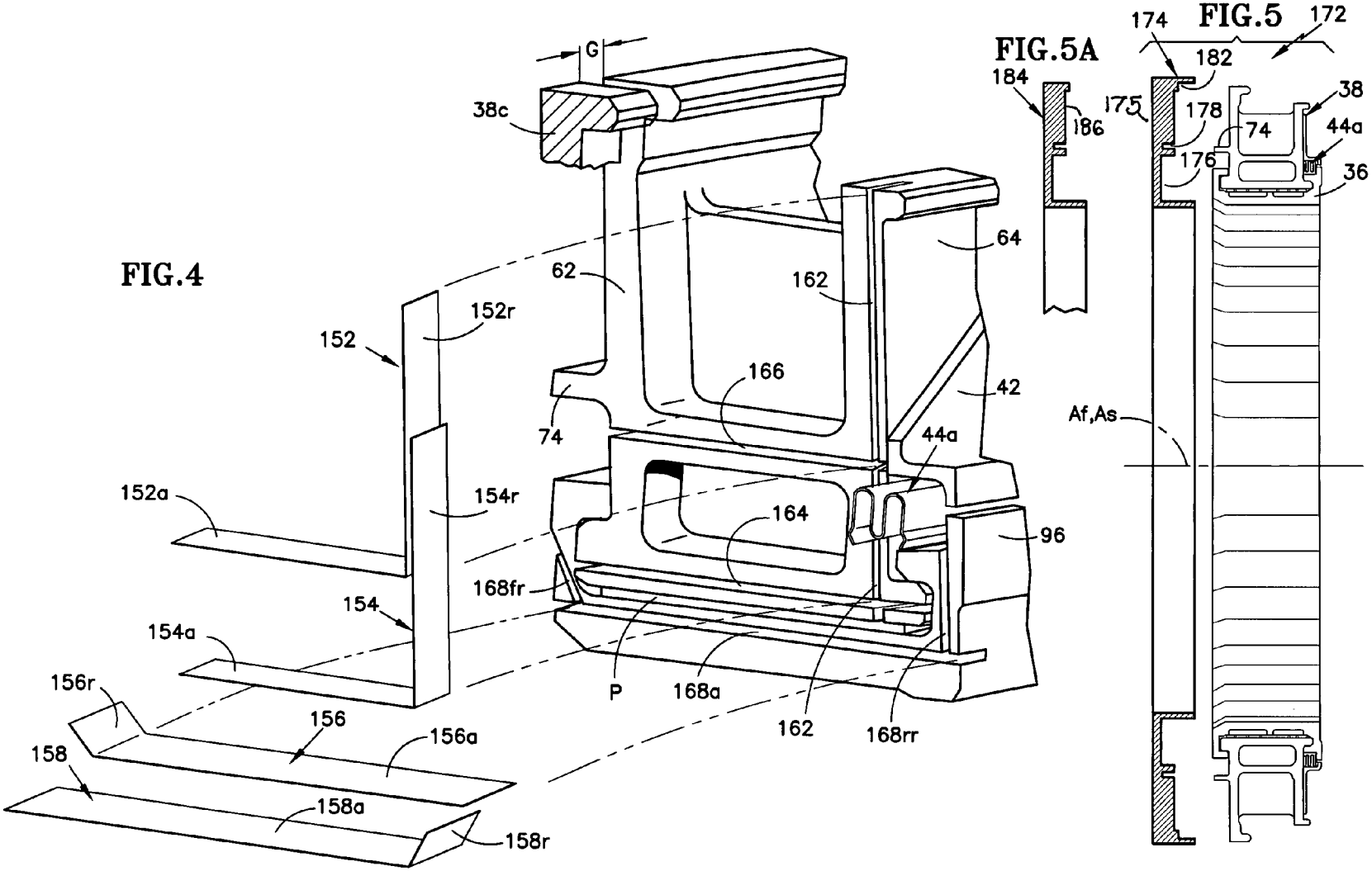
FIG. 4 is a perspective view in exploded fashion of the structure shown in FIG. 2 showing a plurality of feather seals and their relationship with phantom lines to feather seal slots in the end of the structure.
FIG. 5 is a cross-sectional view rotated ninety degrees from the horizontal of a cartridge-like module formed of the outer air seal assembly shown in FIG. 2 and a fixture for forming the outer air seal assembly.
FIG. 5A is a cross-sectional view rotated ninety degrees from the horizontal of a cartridge-like module formed of the outer air seal assembly shown in FIG. 2 and a fixture for inserting the outer air seal assembly into a rotary machine.

FIG. 4 is a perspective view of the outer air seal assembly 34 shown in FIG. 2 with the outer air seal support segment 38*a* and a portion of the adjacent outer air seal support segment 38*c* broken away. A plurality of feather seals 152, 154, 156, 158 are shown in exploded fashion. Phantom lines show the relationship of the feather seals 152, 154 to feather seal slots 162, 164, 166 in the first side 56*a* of outer air seal support segment. The feather seals extend into the second side 58 of the adjacent outer air seal support segment 38*c* in corresponding feather seal slots (not shown).

In particular, the first side 56*a* of the outer air seal support segment 38*a* has a first slot 162 which extends radially between the rearward inner rail 82 to the rearward outer rail 78 to receive radial portions 152*r*, 154*r* of the pair of feather seals 152, 154. The second slot 164 extends axially between the forward inner rail 68 and the rearward inner rail 82. A third slot 166 extends radially outwardly of the second slot, the third slot extending axially between the forward wall 62 and the rearward wall 64. The second and third slots each adapt the side to receive the associated axially extending portions 152*a*, 154*a* of the pair of feather seals 152, 154.

The first feather seal 152 has the radially extending portion 152*r* disposed in the first radial slot 162. The first feather seal has its axially extending portion disposed in the third axial slot 166. The radial and axial portions block the leakage of cooling air from the outer cooling air chamber 132 in between adjacent support segments in both the radial and rearward directions, but some small leakage of cooling air does occur.

The second feather seal 154 has the radially extending portion 154*r* which is also disposed in the first radial slot to block leakage in the rearward direction from the outer cooling air chamber and, the inner cooling air chamber 134 in structures that do not have continuous bulkheads that seal off the inner chamber. The second feather seal has an axially extending portion 154*a* disposed in the third axial slot 166 to radially block the leakage of cooling air from the region between adjacent bulkheads bounding the inner cooling air chamber of adjacent support segments 38*a*, 38*c*. The second feather seal 154 also blocks leakage in the rearward direction from the outer cooling air chamber by the radial portion 154*r* of the second feather seal overlapping the first feather seal 152*r*.

As noted above, FIG. 3 is an enlarged view of a portion the outer air seal assembly 34*a* of FIG. 2. FIG. 3 shows in more detail the alternate embodiment 44*b* of the resilient seal member 44*a* and the adjacent structure which traps the seal member. A leak path for cooling air extends outwardly from the cooling air chamber 144 between the support segment 38 and the outer air seal 36. The leak path extends between the rearward hook 92 of the seal segment (at the inwardly facing surface 94) and the rearward rail 82 of the support segment (at the outwardly facing surface) and thence outwardly. The leak path also includes flow adjacent to the feather seals in a gap G between segments. The leak path is intercepted by the seal chamber 98.

The seal chamber 98 is bounded axially on one side by the support segment 38 (rearward wall 64) and bounded axially on the other side by the outer air seal segments (seal wall 96 of the rearward hooks 92 of at least two outer air seal segments 36*a*, 36*b*). These hooks extend about the support and are spaced axially from the support. In particular, the seal chamber is bounded axially on the upstream side by the rearward walls 64 and is bounded axially on the downstream side by the seal wall 96. The seal wall extends radially from the remaining portion of the rearward hook 92 and is spaced by an axial length Ls from the rearward wall 64 of the outer air seal segment. The rearward hook 92 also has an outwardly facing surface 95 which radially bounds a portion of an annular seal chamber 98.

As shown, the retainer member 42 is disposed in the low pressure region 108 of the seal chamber 98. The retainer member 42 has a first retainer wall 43*a* which extends axially and circumferentially to radially bound the seal chamber. The retainer member 42 has a second retainer wall 43*r* which extends circumferentially and radially from the first retainer wall to form a corner with the first retainer wall. The second retainer wall extends radially inwardly into close proximity with the seal wall 96 of the outer air seal member. The second retainer wall axially bounds the seal chamber leaving a radial gap R between the retainer member and the outer air seal segment. The radial gap R is spaced radially from the top and bottom of the seal chamber.

The second retainer wall 43*r* extends radially adjacent to the opening 104 in the retainer member 42. The second retainer wall is adapted to engage the anti-rotation projection 102 on the associated seal segment in case of an interference rub between the rotor blades and the outer air seal segment. This reduces bearing stresses resulting from engagement between retainer member 42 and the anti-rotation projection on the outer air seal by increasing the area of engagement with the second wall and by reducing the turning moment on the retainer member by having the anti rotation projection on the outer air seal member extend outwardly to engage the first wall of the retainer member at a diameter which is greater than the diameter of the remainder of the outer air seal segment.

The resilient seal member 44*b* has an axial length Lu in the uninstalled condition which is greater than the axial length Ls of the seal chamber. As a result, the resilient seal member in the uninstalled condition has an axial length Lu which is greater than the length Ls in the installed condition. The resilient seal member 44*b* further includes a first arm 45 for engaging the rearward wall 64 of the first structure and a second arm 46 for engaging the seal wall 96 of the second structure. The arms open toward the high pressure region 106 such that high pressure cooling air urges the arms apart into engagement with the walls. In this particular embodiment, the resilient seal member 44 is formed of a series of U-shaped members each having a pair of axially spaced arms diverging to form a U-shaped opening therebetween. Each arm is joined to an arm of the adjacent U-shaped member and disposed in the seal chamber such that the openings in the resilient seal member 44*b* adjacent the first and second arms 45, 46 face the region of higher pressure under operative conditions. Other configurations might be used, such as the alternate embodiment 44*a*, that are provided with arms that are urged by the high pressure cooling air into engagement with the adjacent structure.

As mentioned above, the outer air seal 36 is spaced radially inwardly from the second partition 128 of the outer air seal support to leave the outer air seal cooling air chamber 144 therebetween. The seal section of the outer air seal includes a feather seal slot 168 which faces an associated feather seal slot in the circumferentially adjacent outer air seal segment. The feather seal slot has an axially extending portion 168*a*, a forwardly extending radial portion 168*fr* and a rearwardly extending radial portion 168*rr* which adapt the segment to receive the third feather seal 156 and the fourth feather seal 158.

The third feather seal 156 has an axial portion 156*a* which is disposed in the feather seal slot of the outer air seal segment. The third feather seal extends for substantially the entire length of the axial portion of the feather seal slot in the outer air seal segment. The third feather seal has a radially extending portion 156*r* disposed in the forwardly extending radial portion of the feather seal slot.

Similarly, the fourth feather seal 158 has an axial portion 158*a* which is disposed in the feather seal slot of the outer air seal segment. The fourth feather seal, like the third feather seal, extends for substantially the entire length of the axial portion of the feather seal slot in the outer air seal segment. The fourth feather seal has a radially extending portion 158*r* disposed in the rearwardly extending radial portion of the feather seal slot. The overlapping axial portions of the third and fourth feather seals act to provide a double seal to radially block the leakage of cooling air from the cooling air chamber 144.

FIG. 5 is an exploded cross-sectional view of an outer air seal assembly module 172. The module includes a fixture 174. The cross-sectional view is rotated ninety degrees from the operative condition or horizontal orientation of the module during buildup of the outer air seal assembly 34. The module is shown at completion of the buildup of the outer air seal assembly 34 and prior to disposition in a second fixture for insertion in the engine.

The outer air seal assembly 34 shown in FIG. 5 is the outer air seal assembly shown in FIG. 2. The outer air seal assembly 34 includes the outer air seal support 38 formed of a plurality of outer air seal support segments, the outer air seal 36 formed of a plurality of outer air seal segments and a retainer member 42 with the radially extending seal member 44*a* extending between the structures and trapped with the retainer member.

The fixture 174 extends circumferentially about an axis Af which is coincident with the axis As of the outer air seal assembly 34. The fixture includes an annular support section 175 disposed about the axis As. The fixture in the support section has a first groove 176 which extends circumferentially and which receives the outer air seal with its plurality of outer air seal segments 36*a*, 36*b*. A second groove 178 is radially outwardly of the first groove and extends circumferentially about the support section. The second groove receives the axial projection 74 on the forward wall 62 of the outer air seal support 38. A third groove 182 is radially outwardly of the second groove and extends circumferentially about the support section. The third groove receives the forward inner rail 68 of the outer air seal support.

During buildup, the fixture is disposed horizontally on a surface, such as a flat plate, with the axis Af extending in the vertical direction. As mentioned the module 172 is built-up of segments including the support segments, such as the support segments 38*a*, 38*b* (shown in FIG. 3), and 38*c* (shown in FIG. 4); the outer air seal segments, such as the segments 36*a*, 36*b* shown in FIG. 3; and the retainer segments 42. The outer air seal support segments and the outer air seal segments are disposed on the fixture 174. The segments are moved to a slightly larger diameter about the axis Af than the segments have in the installed condition in the fixture. The feather seals 152, 154, 156, 158 are inserted. The outer air seal segments are then moved into the grooves l76, 178, 182 of the fixture decreasing the diameter of the segments and trapping the feather seals. The resilient seal member 42 is a radially split ring having circumferentially facing ends so that one portion circumferentially overlaps the adjacent portion. The resilient seal member is then installed in the seal chamber where the seal member is partially trapped by the rear wall 64 of the support segments and the seal wall 96 of the outer air seal segments. The segments of the retainer member and their associated bolts 112 are then installed. If desired, access through the opening 118 in the forward wall 62 permits installation of a tying member. Examples of tying members are a thin flexible plastic material; a bolt having a centerline offset from the centerline of the opening 118 and a small radial projection; and, a bolt terminating in a thin L- shaped projection at its end to engage the rearward facing surface of the retainer member. The tying member blocks movement of the segments of the outer air seal assembly, the support segments and the retainer members.

FIG. 5A is a cross-sectional view of a second module 184 with a portion broken away to show a second fixture 186 for installing the outer air seal assembly 34 of FIG. 5 in the turbine section 14. The second fixture differs from the fixture 174 in that the second fixture 186 does not have the outermost groove 182 and terminates radially inwardly of that location. As result, the fixture does not interfere with insertion of the cartridge-like outer air assembly module into the engine.

The method of installing the built-up outer air seal assembly in the second fixture 186 is simplified by the formation of the module 172. The method includes disposing a restraining member, such as a flat plate, on top of the module 172 with the axis of the fixture Af extending in the vertical direction. This causes the flat plate to rest on the module 172, with the flat plate engaging the rearward portion of the outer air seal assembly 34. The horizontally disposed fixture 174 and the outer air seal assembly are clamped together with the flat plate. The unit of the module and the flat plate is simply turned upside down such that the outer air seal assembly now rests on the flat plate. In other words, the flat plate is turned from being on top of the out air seal assembly to being underneath the outer air seal assembly. The fixture 174 is lifted off and the fixture 186 is mounted to the outer air assembly with tying members, as was done with fixture 174. This permits inserting in the module 184 into the engine, removing the tying members, and installing attachment bolts 116 through the holes 114 to secure the outer air seal assembly to the engine.

This design permits the ready insertion and bolting-up of a complete outer air seal assembly in the engine decreasing the time needed to complete installation of the outer air seal assembly and decreasing the chance for parts to be lost in the engine. The modular nature of the outer air assembly enables installation of critical parts, such as the outer air seal, the feather seals, and the resilient seal member 44 and inspection of these parts and the resilient seal member for correct orientation after installation. In turn, this reduces the amount of time needed to overhaul an engine or to build up a new engine. In particular, during an engine overhaul, having the outer air seal assembly in stock as an independent, interchangeable unit for later insertion into the engine allows for the replacement or interchanging of damaged parts without having to take time to tear down individual parts from the engine to repair the damaged assembly by repairing or replacing individual parts. Removing the parts as one unit decreases the cost of overhauling an engine and reduces the downtime for damaged engines, permitting the return of the overhauled engine to active service.

During operation of the engine 10 shown in FIG. 1, hot working medium gases are flowed along the annular flowpath 12 through the turbine section 14 of the engine 10. The hot gases are expanded through the rotor assembly 18 driving the rotor blades circumferentially about the axis of rotation.

Interference contact between the rotor blades and the circumferentially extending outer air seal 36 urges the outer air seal segments in the circumferential direction. The retainer member 42, which is formed of an array of retainer segments, is engaged by the array of outer air seal segments, at least one of which has the radially extending anti-rotation projection 102. The anti-rotation projection extends into the associated opening 104 in the retainer segment to prevent circumferential movement of the array of outer air seal segments. In the embodiment shown, each retainer segment engages a pair of seal segments 36*a*, 36*b*.

Circumferential engagement between the anti-rotation member or lug 102 on the outer air seal 36 and the retainer member 42 blocks circumferential movement of the outer air seal 36 in response to the force exerted by the rotor blades 24. This circumferentially directed force creates a turning moment that must be resisted by the retainer member. An advantage is the durability of the outer air seal assembly, which is a subassembly for the engine 10, for a given weight and axial thickness of the seal retainer. This results from the level of force exerted by the seal retainer that is required to provide the anti-rotation moment needed to resist the turning moment acting on the seal segment during a rub of a rotor blade. By having the anti-rotation element or lug extend outwardly from the hook of the outer air seal segment to a larger diameter, the moment arm acted on by the resisting force is larger than the moment arm for an assembly having the same construction except for having the lug extend inwardly from the seal retainer to engage the outer air seal segment at a smaller diameter.

Cooling air is flowed from the interior of the outer air seal assembly 34 through the outer chamber 132 and the inner chamber 134 of the support segment 38. The cooling air is flowed thence through the second partition 128 to impinge on the outer air seal segment 36*a* and through the cooling holes 148 in the outer air seal to provide film cooling to the exterior of the seal section 48 over the seal surface 52. The leak path extends from the cooling air chamber 144 of the outer air seal between segments at the feather seals and elsewhere due to slight mismatches in structure because of tolerances.

For example, the leak path extends between the inwardly facing surface 94 (of the rearward hook 92) and the outwardly facing surface 84 (of the rearward inner rail 82). The leak path is intercepted by the seal chamber 98. The high-pressure cooling air enters the high-pressure region 106 of the seal chamber and exerts axially directed forces on the arms 45, 46 of the resilient seal member 44*a* (FIG. 3, 4) or the resilient seal member 44*b* (FIG. 2). The resilient seal member is urged radially against the retainer member 42 where the resilient seal member is restrained against further radial movement. The resilient seal member is also urged axially against the first structure (rearward wall 64 of outer air seal support 38) and the second structure (seal wall 96 of the outer air seal 36*a*). The arms 45, 46 of the resilient seal member are urged axially by being compressed axially at installation and by the pressurized cooling air of the leak path acting on the first and second arms to block the flow of cooling air through the seal chamber 98. As a result blocking the loss of cooling air, the cooling air that might have been lost from the cooling air chamber adjacent the outer air seal may instead be flowed through the outer air seal segments through cooling air holes to provide useful cooling. This reduces the need to pressurize additional cooling air to make up for the cooling air lost to the leak path. Accordingly, an advantage of this construction is the efficiency of the engine 10 that results from using the cooling air for useful cooling rather than losing the cooling air to a leak path.

A particular advantage of the present invention is the many functions performed by the retainer member 42. For example, the retainer member in cooperation with the anti-rotation member on the outer air seal, positively locates the outer air seal segment in the circumferential direction at build up, installation, and under operative conditions. In addition, the retainer member provides access to the seal chamber 98 for installing, locating and enclosing the resilient seal member 44 under non-operative conditions of the engine and for retaining the resilient seal member radially against cooling air pressure under operative conditions.

As shown in FIG. 3, any axial gap between the support segment 38*a* and the retainer member 42 is smaller than the axial gap between the support segment and the first arm of the resilient seal member at the outer diameter of the resilient seal member. This provides an advantage in durability of the resilient seal member by ensuring that the outermost portion of the resilient seal member is not trapped or pinched as a result of moving into the gap between the support segment and retainer member 42.

As shown in FIG. 3, the axial thickness of the second retainer wall 43*r* on the retainer member 42 is less than the axial thickness of the outwardly extending seal wall 96 of the outer air seal segment 36*a*. This ensures that the second retainer wall is overlapped in the axial upstream and axial downstream directions by the seal wall extending beyond the second retainer wall. This ensures positive engagement between the base of the resilient seal member 44 and the seal wall 96 of the outer air seal member under operative conditions forms the necessary sealing engagement for the seal chamber. Further, the inner portion of a seal wall is axially thicker than the outer portion of the seal wall to ensure that the base of the resilient seal member engages the seal wall at a location that is radially outwardly of the engagement between the anti-rotation member of the outer air seal segment and the second wall of the retainer member 42.

Although the invention has been shown and described with respect to detailed embodiments thereof, it should be understood by those skilled in the art that various changes in form and detail may be made without departing from the spirit and scope of the claimed invention.

We claim:

1. For a stator assembly for a rotary machine having an operative condition and a non-operative condition, an axis A, an annular flow path for working medium gases disposed about the axis A, an outer case outwardly of the annular flowpath for working medium gases, a supply chamber for cooling air from which a leak path for cooling air extends, an assembly of a plurality of segments that form a radially facing seal surface for bounding the working medium flow path which comprises:

A. a first structure which extends inwardly from the outer case and which is adapted to extend circumferentially about and outwardly of a plurality of segments that form the radially facing seal surface for bounding the working medium flow path, to support the array of seal segments, the first structure bounding a supply chamber for cooling air, the first structure having an array of circumferentially extending segments which partially bound the supply chamber, at least two of the segments being adjacent support segments, each support segment having a radially extending wall;

B. a second structure which is engaged by the first structure, which is a radially facing seal having the seal surface which extends circumferentially about the axis A to bound the working medium flow path, the seal including an array of seal segments which are circumferentially spaced leaving a circumferential gap G' therebetween, at least two of which segments have a radially extending seal wall which extends inwardly, the seal wall extending circumferentially and being spaced from the radially extending wall of the first structure by an axial length Ls leaving an annular seal chamber therebetween for intercepting the leak path for cooling air;

C. a resilient seal member that extends across the axial length Ls between the radially extending wall of the first structure and the seal wall of the seal segment to divide the seal chamber into a high pressure region and a low pressure region;

D. a retainer member disposed in the low pressure region which faces radially and extends axially across the axial length Ls to bound a portion of the seal chamber, which is removably attached to the first structure of the stator assembly for locating and retaining the resilient seal member and for providing access to the chamber during assembly and disassembly of the resilient seal member;

wherein the seal chamber is bounded axially on one side by the support segment and bounded axially on the other side by at least two seal segments which extend about the support and are spaced axially from the support;

wherein the resilient seal member is urged radially against the retainer member and urged axially against the first structure and the second structure by pressurized cooling air of the leak path to block the flow of cooling air through the seal chamber, the retainer member being removably attached to the support structure and that is so located and constructed with respect to the seal chamber that the retainer member adapts the assembly for providing access to the seal chamber for installing, locating and enclosing the seal member under the non-operative condition of the engine and for retaining the seal member radially against cooling air pressure under the operative condition.

2. The assembly of segments of claim 1, wherein an anti-rotation projection extends radially from the seal wall bounding the annular seal chamber and is adapted to extend into an associated opening of a retainer member of the first structure and wherein the retainer member of the first structure, which is removably attached to the first structure and which is constructed and located to provide access to the seal chamber, which is formed of an array of retainer segments, is engaged by the array of outer air seal segments, at least one of which has the radially extending anti-rotation projection which extends into an associated opening in the retainer segment to prevent circumferential movement of the array of outer air seal segments.

3. The assembly of segments of claim 2 wherein the retainer member has a first retainer wall which extends axially and circumferentially to bound the seal chamber, and a second retainer wall which extends circumferentially and radially from the first retainer wall to form a corner with the first retainer wall, the second retainer wall extending radially inwardly into close proximity with the seal wall of the outer air seal member axially bounding the seal chamber leaving a radial gap R therebetween, the radial gap R being spaced from the top and bottom of the seal chamber, the second retainer wall extending radially adjacent to the opening in the retainer member to engage the anti-rotation projection on the associated seal segment to reduce bearing stresses resulting from engagement between retainer member and the anti-rotation projection on the outer air seal by increasing the area of engagement with the second wall and reducing the turning moment on the retainer member by having the anti rotation projection on the outer air seal member extend outwardly to engage the first wall of the retainer member at a diameter which is greater than the diameter of the remainder of the outer air seal segment.

4. The assembly of segments of claim 1, wherein the resilient seal member has arms opening toward the high pressure region to engage the radially extending wall of the first structure and the radially extending seal wall of the seal segment, an axial gap between the radially extending wall of the first structure and the retainer member is smaller than the axial gap between the radially extending wall of the first structure and the arm of the resilient seal member at the outer diameter of the resilient seal member.

5. The assembly of segments of claim 1, wherein the retainer member has a first retainer wall which extends axially and circumferentially to bound the seal chamber, and a second retainer wall which extends circumferentially and radially from the first retainer wall to form a corner with the first retainer wall, the second retainer wall extending radially inwardly into close proximity with the seal wall of the outer air seal member axially bounding the seal chamber leaving a radial gap R therebetween, the radial gap R being spaced from the top and bottom of the seal chamber; and, wherein the axial thickness of the second retainer wall on the retainer member is less than the axial thickness of the inwardly extending wall of the outer air seal member to promote engagement between the base of the resilient seal member and the wall of the outer air seal member in the operative condition.

6. The assembly of segments of claim 1, wherein the resilient seal member has an axial length Lu in the uninstalled condition which is greater than the axial length Ls of the seal chamber such that the resilient seal member in the uninstalled condition has an axial length Lu which is greater than the length in the installed condition, the resilient member further including a first arm and a second arm for engaging the seal wall of the second structure and the rearward wall of the first structure, the arms opening toward the high pressure region such that high pressure cooling air urges the arms apart into engagement with the walls.

7. A method of forming an outer air seal assembly for a rotary machine having an axis A, and an annular flow path for working medium gases disposed about the axis A, comprising:

forming a first module by disposing the outer air seal assembly in a first fixture having grooves for receiving the rearward side of the outer air seal assembly, the fixture extending outwardly of the outer diameter of the outer air seal assembly;

forming a second module by disposing the outer air seal assembly in a second fixture having a diameter that is smaller than the outer diameter of the outer air seal assembly;

inserting the second module in the rotary machine;

securing the outer air seal assembly to the rotary machine and removing the second fixture from the engine.

8. For a stator assembly for a rotary machine having a non-operative condition and an operative condition, having an axis A, an annular flow path for working medium gases disposed about the axis A, a supply chamber for cooling air from which a leak path for cooling air extends, an assembly of a plurality of segments that form a radially facing seal surface for bounding the working medium flow path which comprises:

a stator assembly having two circumferentially extending structures that are spaced apart leaving an annular seal chamber therebetween for intercepting a leak path for cooling air, a resilient seal member that extends across the space between the structures to divide the seal chamber into a high pressure region and a low pressure region and that has arms opening toward the high pressure region, each of which engages one of said circumferentially extending structures and each of which is urged against one of said associated structures bounding the seal chamber under the operative condition;

a retainer member disposed in the low pressure region of the seal chamber that extends across the space between said circumferentially extending structures, the retainer member being removably attached to one of said structures which adapts the assembly to provide access to the seal chamber for installing and for locating the resilient seal member under a non-operative conditions of the assembly and for retaining the resilient seal member under an operative condition of the assembly;

wherein the retainer member which is removably attached to one of said structures is so located and constructed with respect to the seal chamber that the retainer member adapts the assembly to provide access to the seal chamber that extends between the structures and to the resilient seal member that is disposed in the seal chamber to locate the resilient seal member during assembly and disassembly of the resilient seal member.

9. For a stator assembly for a rotary machine having a non-operative condition and an operative condition, having an axis A, an annular flow path for working medium gases disposed about the axis A, an assembly of a plurality of seal segments that form a radially facing seal surface for bounding the working medium flow path, a support structure for engaging the seal segments having a supply chamber for cooling air from which a leak path for cooling air extends, a stator assembly which comprises:

the support structure having a radially extending wall, at least two of the assembly of seal segments having a radially extending seal wall extending circumferentially and being spaced axially from the radially extending wall of the support structure leaving an annular seal chamber therebetween that intercepts the leak path for cooling air;

a resilient seal member which extends circumferentially in the annular seal chamber and axially between the radially extending wall of the support structure and the seal wall of said at least two segments to divide the seal chamber into a high pressure region and a low pressure region, the resilient seal member having arms opening toward the high pressure region, one of said arms engaging the radially extending wall of the support structure and the other of said arms engaging the seal wall, and being urged against its associated wall bounding the seal chamber under the operative condition;

a retainer member that is removably attached to the support structure, that is disposed outwardly of the resilient seal means and that extends axially and faces radially to bound at least a portion of the seal chamber;

wherein under the operative condition the resilient seal member is urged radially against the retainer member and urged axially against the support structure and the seal segments by pressurized cooling air of the leak path to block the flow of cooling air through the seal chamber;

wherein the retainer member being removably attached to the support structure is so located and constructed with respect to the seal chamber that the retainer member adapts the assembly to provide access to the seal chamber for installing, locating and enclosing the seal member under a non-operative condition of the rotary machine and for retaining the seal member in the seal chamber radially against cooling air pressure under the operative condition.

10. An outer air seal assembly module having an outer air seal assembly for installation in a rotary machine having an axis A, an annular flow path for working medium gases disposed about the axis A, the outer air seal assembly module, which comprises:

an outer air seal assembly which extends circumferentially about an axis As, the outer air seal assembly including an outer air seal formed of a plurality of segments disposed circumferentially about the axis As, an outer air seal support which engages the outer air seal to support the outer air seal, the outer air seal support being formed of a plurality of outer air seal support segments each of which extends circumferentially and outwardly of an associated outer air seal segment and engages said at least one outer air seal segment, each support segment having a forward wall and a rearward wall, the rearward wall being spaced axially from the outer air seal leaving a seal chamber extending circumferentially therebetween, the forward wall having an outer rail extending circumferentially about the outer air seal support, and an axial projection extending circumferentially about the outer air seal support that is disposed radially between the outer rail and the outer air seal;

a resilient seal member that extends across the space between the rearward wall of the outer air seal support segments and the outer air seal that forms the seal chamber to divide the seal chamber into a high pressure region and a low pressure region and that has arms opening toward the high pressure region to engage the outer air seal support and the outer air seal; and, a retainer member formed of plurality of retainer member segments, the retainer member extending across the space in the low pressure region, the retainer member being removably attached to the outer air seal support for locating and retaining the resilient seal member and for providing access to the chamber during assembly and disassembly of the resilient seal member;

a fixture extending circumferentially about an axis Af which is coincident with axis As of the outer air seal assembly, the fixture including an annular support section disposed about the axis As having a first groove which extends circumferentially and which receives the outer air seal having a plurality of outer air seal segments;

a second groove radially outwardly of the first groove, which extends circumferentially, and which receives the axial projection on the forward wall of the outer air seal support, and a third groove radially outwardly of the second groove, which extends circumferentially, and which receives the inner rail of the outer air seal support;

wherein the fixture enables the buildup of the outer air seal assembly external to the rotary machine and permits the installation of the resilient seal member and inspection of its location prior to assembly of the module into the rotary machine;

wherein the resilient seal member is urged radially against the retainer member and urged axially against the first structure and the second structure by pressurized cooling air under operative conditions; and, wherein the retainer member provides access to the seal chamber for installing, locating and enclosing the seal member under non-operative conditions of the engine and for retaining the seal member radially against cooling air pressure under operative conditions.

11. A stator assembly for a rotary machine having an axis A, an annular flow path for working medium gases disposed about the axis A, an outer case outwardly of the annular flowpath for working medium gases, a supply chamber for cooling air from which a leak path for cooling air extends, which comprises:

A. a first structure which extends inwardly from the outer case and which is adapted to extend circumferentially about and outwardly of an outer air seal assembly to support an array of outer air seal segments, the first structure bounding a supply chamber for cooling air, the first structure having an array of circumferentially extending segments which partially bound the supply chamber, at least two of the segments being adjacent support segments, each support segment having a forward wall which has a forward outer rail which engages the outer case, a forward inner rail which is spaced radially from the forward outer rail and which extends axially in the forward direction and which has an outwardly facing surface which extends circumferentially about the axis A, a rearward wall which is spaced axially from the forward wall leaving a portion of the supply chamber therebetween having a rearward outer rail which engages the outer case, and a rearward inner rail which is spaced radially from the rearward outer rail, which extends axially in the rearward direction and which has an outwardly facing surface which extends circumferentially about the axis A, a first side which faces circumferentially, a second side which faces circumferentially which is spaced circumferentially from the first side, each of said sides being spaced from the associated side of the adjacent segment by a circumferential gap G, each of said sides having a first slot extending radially between the rearward outer rail and the rearward inner rail which adapts the side to receive a pair of feather seals each having a radially extending portion and an axially extending portion, a second slot extending axially between the forward inner rail and the rearward inner rail, a third slot radially outwardly of the second slot, the third slot extending axially between the forward wall and the rearward wall, the second and third slots each adapting the side to receive the associated axially extending portion of a pair of radially extending feather seals, a first circumferentially extending partition extending from the forward wall to the rearward wall dividing the supply chamber into an inner cooling air chamber and an outer cooling air chamber and having cooling air holes which place the inner cooling air chamber in flow communication with the outer cooling air chamber, a second circumferentially extending partition extending from the forward wall to the rearward wall which is spaced radially outwardly from the first partition to bound the inner cooling air chamber and which has a plurality of cooling air holes that place the outer cooling air chamber in flow communication with the exterior of the support structure, a first radially extending bulkhead which is spaced by a distance Da from the first side, which circumferentially bounds the inner cooling air chamber and which circumferentially bounds a portion of the outer cooling air chamber, a second radially extending bulkhead which is spaced by a distance Db from the first side, which is spaced by a distance Dc from the first bulkhead that is greater than the distance Db, which circumferentially bounds the inner cooling air chamber and which circumferentially bounds a portion of the outer cooling air chamber;

a first feather seal having a radially extending portion disposed in the first radial slot and an axially extending portion disposed in the third axial slot to block cooling air from flowing from the outer cooling air chamber between adjacent inner segments in the radial and rearward directions;

a second feather seal having a radially extending portion disposed in the first radial slot and an axially extending portion disposed in the second axial slot to block cooling air from flowing from the outer cooling air chamber between adjacent support segments in the rearward direction by the axial portion overlapping the first feather seal and block the leakage of cooling air from the inner cooling air chamber between adjacent support segments in the radial and rearward directions;

B. a second structure which is an outer air seal having a seal surface which extends circumferentially about the axis A to bound the working medium flow path, the outer air seal including an array of outer air seal segments which are circumferentially spaced leaving a circumferential gap G' therebetween, at least two of which segments have a seal section which extends axially and circumferentially and which has a portion of the seal surface and which is spaced radially inwardly from the second partition to leave an outer air seal cooling air chamber therebetween, the seal section including a feather seal slot having an axially extending portion, a forwardly extending radial portion and a rearwardly extending radial portion which adapts the segment to receive a third feather seal and a fourth feather seal;

a forward hook which extends axially forward from the seal section over the inner rail of the forward wall of the first structure, the forward hook having an inwardly facing surface which slidably engages the circumferentially extending support at the outwardly facing surface of the forward rail of the associated segment of the first structure;

a rearward hook which extends axially rearward from the seal section over the rearward rail of the first structure, the rearward hook having an inwardly facing surface which slidably engages the circumferentially extending support at the outwardly facing surface of the rearward rail of the associated segment of the first structure the leak path for cooling air extending between the engaging hook and rail surfaces, and, an outwardly facing surface which bounds a portion of an annular seal chamber for intercepting the leak path for cooling air;

a radially extending seal wall which extends inwardly from the rearward hook, the seal wall extending circumferentially and being spaced from rearward wall of the first structure by an axial length Ls leaving the annular seal chamber therebetween for intercepting the leak path for cooling air, an anti-rotation projection extending radially from the seal wall which is adapted to extend into an associated opening of a retainer member which is removably attached to the first structure;

the third feather seal having an axial portion which is disposed in and extends for substantially the entire length of the axial portion of the feather seal slot in the outer air seal segment and having a radially extending portion disposed in the forwardly extending radial portion of the feather seal slot; and, the fourth feather seal having an axial portion which is disposed in and extends for substantially the entire length of the axial portion of the feather seal slot in the outer air seal segment and having a radially extending portion disposed in the rearwardly extending radial portion of the feather seal slot, the overlapping axial portions of the third and fourth feather seals blocking the leakage of cooling air radially from the cooling air chamber;

C. a resilient seal member that extends across the axial length Ls between the rearward wall of the first structure and the seal wall of the outer air seal segment to divide the seal chamber into a high pressure region and a low pressure region, the resilient seal member having an axial length Lu in the uninstalled condition which is greater than the axial length Ls of the seal chamber such that the resilient seal member in the uninstalled condition has an axial length Lu which is greater than the length in the installed condition, the resilient member further including a first arm and a second arm for engaging the seal wall of the second structure and the rearward wall of the first structure, the arms opening toward the high pressure region such that high pressure cooling air urges the arms apart into engagement with the walls, D. the retainer member being a retainer member which is disposed in the low pressure region, which faces radially and extends axially across the axial length Ls to bound the seal chamber, which is removably attached to the first structure of the stator assembly for locating and retaining the resilient seal member and for providing access to the chamber during assembly and disassembly of the resilient seal member, the retainer member having a first retainer wall which extends axially and circumferentially to bound the seal chamber, a second retainer wall which extends circumferentially and radially from the first retainer wall to form a corner with the first retainer wall, the second retainer wall extending radially inwardly into close proximity with the seal wall of the outer air seal member axially bounding the seal chamber leaving a radial gap R therebetween, the radial gap R being spaced from the top and bottom of the seal chamber, the second retainer wall extending radially adjacent to the opening in the retainer member to engage the anti-rotation projection on the associated seal segment to reduce bearing stresses resulting from engagement between retainer member and the anti-rotation projection on the outer air seal by increasing the area of engagement with the second wall and reducing the turning moment on the retainer member by having the anti rotation projection on the outer air seal member extend outwardly to engage the first wall of the retainer member at a diameter which is greater than the diameter of the remainder of the outer air seal segment;

wherein the seal chamber is bounded axially on one side by the support segment and bounded axially on the other side by the radially extending seal wall of at least two outer air seal segments which extend about the support and are spaced axially from the support;

wherein the resilient seal member is urged radially against the retainer member and urged axially against the first structure and the second structure by pressurized cooling air of the leak path to block the flow of cooling air through the seal chamber, the retainer member providing access to the seal chamber for installing, locating and enclosing the seal member under non-operative conditions of the rotary machine and for retaining the seal member radially against cooling air pressure under operative conditions;

wherein the retainer member, which is formed of an array of retainer segments, is engaged by the array of outer air seal segments, at least one of which has the radially extending anti-rotation projection which extends into an associated opening in the retainer segment to prevent circumferential movement of the array of outer air seal segments;

wherein an axial gap between the support and the retainer member is smaller than the axial gap between the support and the wall of the resilient seal member at the outer diameter of the resilient seal member;

wherein the second retainer wall on the retainer member and the radially extending seal wall each have an axial thickness; and wherein the axial thickness of the second retainer wall on the retainer member is less than the axial thickness of the radially extending seal wall of the outer air seal member to promote engagement between the base of the resilient seal member and the wall of the outer air seal member in the operative condition.

* * * * *